US007833068B2

(12) United States Patent
Bright et al.

(10) Patent No.: US 7,833,068 B2
(45) Date of Patent: Nov. 16, 2010

(54) RECEPTACLE CONNECTOR FOR A TRANSCEIVER ASSEMBLY

(75) Inventors: Edward John Bright, Middletown, PA (US); Michael Frank Cina, Elizabethtown, PA (US); Harold William Kerlin, Port Royal, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 124 days.

(21) Appl. No.: 12/353,511

(22) Filed: Jan. 14, 2009

(65) Prior Publication Data

US 2010/0178790 A1 Jul. 15, 2010

(51) Int. Cl.
*H01R 13/40* (2006.01)

(52) U.S. Cl. ..... 439/733.1

(58) Field of Classification Search ..... 439/346, 439/733.1, 752, 745, 869, 873, 74, 79, 637, 439/680

See application file for complete search history.

(56) References Cited

U.S. PATENT DOCUMENTS

| | | | | |
|---|---|---|---|---|
| 4,392,705 | A | 7/1983 | Andrews, Jr. et al. | |
| 4,632,495 | A * | 12/1986 | Furman | 439/660 |
| 4,988,316 | A * | 1/1991 | Roy | 439/744 |
| 5,199,886 | A * | 4/1993 | Patterson | 439/79 |
| 5,292,261 | A * | 3/1994 | Hirano et al. | 439/752 |
| 5,380,225 | A | 1/1995 | Inaoka | |
| 5,766,041 | A | 6/1998 | Morin et al. | |
| 5,957,732 | A * | 9/1999 | Ito et al. | 439/752 |
| 6,004,160 | A | 12/1999 | Korsunsky et al. | |
| 6,077,105 | A * | 6/2000 | Jochen et al. | 439/497 |
| 6,210,224 | B1 * | 4/2001 | Wu | 439/607.4 |
| 6,231,355 | B1 | 5/2001 | Trammel et al. | |
| 6,292,294 | B1 * | 9/2001 | Takahashi et al. | 359/455 |
| 6,517,382 | B2 | 2/2003 | Flickinger et al. | |
| 6,558,202 | B1 | 5/2003 | Hahn | |
| 6,743,057 | B2 | 6/2004 | Davis et al. | |
| 6,749,468 | B2 | 6/2004 | Avery | |
| 6,752,663 | B2 * | 6/2004 | Bright et al. | 439/607.25 |
| 6,816,376 | B2 | 11/2004 | Bright et al. | |
| 6,926,565 | B2 | 8/2005 | Fogg | |
| 6,994,597 | B2 * | 2/2006 | Majima | 439/752 |
| 7,007,217 | B2 | 2/2006 | Fujii et al. | |
| 7,025,617 | B2 | 4/2006 | Regnier et al. | |
| 7,044,763 | B1 * | 5/2006 | Inoue et al. | 439/326 |
| 7,048,567 | B2 | 5/2006 | Regnier et al. | |
| 7,070,446 | B2 | 7/2006 | Henry et al. | |
| 7,090,523 | B2 | 8/2006 | Shirk et al. | |
| 7,198,519 | B2 | 4/2007 | Regnier et al. | |
| 2005/0164533 | A1 * | 7/2005 | Regnier et al. | 439/79 |

* cited by examiner

*Primary Examiner*—Alexander Gilman

(57) ABSTRACT

A receptacle connector includes a housing having a front, a rear, and a cavity configured to receive a mating connector through a slot at the front of the housing. A plurality of contacts are loaded into the cavity of the housing through the rear of the housing, and the contacts have channel portions aligned with one another. A retention plug is separately provided from the housing and securely coupled to the rear of the housing. The retention plug is received within the channel portions of the contacts and engages the contacts to hold the contacts within the cavity.

20 Claims, 7 Drawing Sheets

RECEPTACLE CONNECTOR FOR A TRANSCEIVER ASSEMBLY

BACKGROUND OF THE INVENTION

The subject matter herein relates generally to a transceiver assembly, and more particularly, to a receptacle connector for use in a transceiver assembly.

Various types of fiber optic and copper based transceiver assemblies that permit communication between electronic host equipment and external devices are known. These transceiver assemblies typically include a module assembly that can be pluggably connected to a receptacle in the host equipment to provide flexibility in system configuration. The module assemblies are constructed according to various standards for size and compatibility, one standard being the Small Form-factor Pluggable (SFP) module standard.

The SFP module is plugged into a receptacle assembly that is mounted on a circuit board within the host equipment. The receptacle assembly includes an elongated guide frame, or cage, having a front that is open to an interior space, and an electrical connector disposed at a rear of the cage within the interior space. Both the connector and the guide frame are electrically and mechanically connected to the circuit board, and when an SFP module is plugged into the receptacle assembly, the SFP module is electrically and mechanically connected to the circuit board as well. Conventional SFP modules and receptacle assemblies perform satisfactorily carrying data signals at rates up to 2.5 gigabits per second (Gbps).

Another pluggable module standard, the XFP standard, calls for the transceiver module to carry data signals at rates up to 10 Gpbs. Transmission of data signals at such a high rate compared to SFP modules raises problems not experienced previously in SFP modules. For example, conventional contact configurations of the electrical connector at the rear of the receptacle are inadequate for transmitting the data signals at the desired transmission rates. Electrical parameters such as impedance, crosstalk, skew and jitter are negatively impacted by the conventional design of the electrical connector. While steps have been taken to solve the signal integrity issues caused by 10 Gpbs signals, particularly where there is only one transmit and one receive signal, problems still remain with maintaining signal integrity. For example, there is presently in development by an Industry Group, IEEE P802.3ba "10 Gbps and 100 Gbps Ethernet Task Force", that transmits and receives multiple 10 Gpbs signals in a parallel configuration. Systems utilizing the parallel configuration have problems maintaining signal integrity. It would be desirable to provide an electrical connector for the receptacle assembly that exhibits good electrical characteristics at high data transmission rates. It would be desirable to provide an interface that exhibits good electrical characteristics in systems that transmit and receive multiple 10 Gpbs signals in a parallel configuration.

BRIEF DESCRIPTION OF THE INVENTION

In one embodiment, a receptacle connector is provided that includes a housing having a front, a rear, and a cavity configured to receive a mating connector through a slot at the front of the housing. A plurality of contacts are loaded into the cavity of the housing through the rear of the housing, and the contacts have channel portions aligned with one another. A retention plug is separately provided from the housing and securely coupled to the rear of the housing. The retention plug is received within the channel portions of the contacts and engages the contacts to hold the contacts within the cavity.

In another embodiment, a receptacle connector is provided for mating with a pluggable module of a transceiver assembly. The receptacle connector includes a housing having a front and a rear. The housing includes a cavity configured to receive a mating connector through a slot at the front of the housing. A plurality of contacts are loaded into the cavity of the housing through the rear of the housing. The contacts define signal contacts and ground contacts arranged in a ground-signal-signal-ground arrangement. A retention plug is separately provided from the housing and securely coupled to the rear of the housing. The retention plug has a base and a plurality of fingers extending from the base. The retention plug is coupled to the housing and engages the contacts to hold the contacts within the cavity. The retention plug is arranged such that the fingers are positioned between adjacent signal contacts.

In a further embodiment, a transceiver assembly is provided that includes a receptacle guide frame configured to be mounted to a host circuit board, where the receptacle guide frame has a front being open to an interior space, and where the receptacle guide frame is configured to receive a pluggable module through the front. A receptacle connector is received within the interior space of the receptacle guide frame at a rear of the receptacle guide frame. The receptacle connector includes a housing having a front, a rear, and a cavity configured to receive the pluggable module through a slot at the front of the housing. A plurality of contacts are loaded into the cavity of the housing through the rear of the housing. A retention plug is separately provided form the housing and is securely coupled to the rear of the housing. The retention plug has an elongated base extending along the rear of the housing. The base engages the contacts to hold the contacts within the cavity.

DETAILED DESCRIPTION OF THE INVENTION

Figure 1:
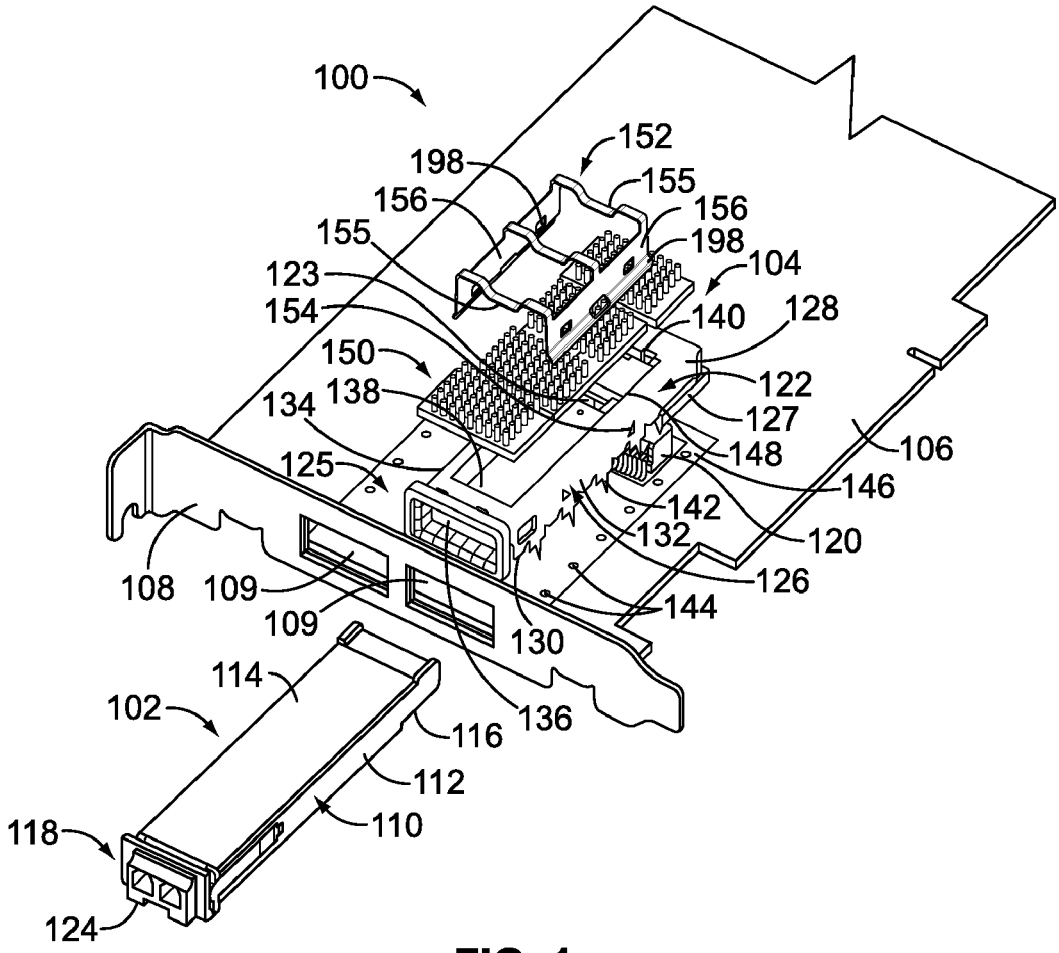
FIG. 1 is an exploded perspective view of a transceiver assembly formed in accordance with an exemplary embodiment.

FIG. 1 illustrates a transceiver assembly 100 adapted to address, among other things, conveying data signals at high rates, such as data transmission rates of 10 gigabits per second (Gbps) required of the XFP standard. It is appreciated, however, that the benefits and advantages of the subject matter described herein may accrue equally to other data transmission rates and across a variety of systems and standards.

As shown in FIG. 1, the assembly 100 generally includes a pluggable module 102 configured for pluggable insertion into a receptacle assembly 104 that is mounted to a host circuit board 106, which, in turn, is mounted in a host system such as a router or computer (not shown). The host system typically includes a conductive chassis having a bezel 108 including openings 109 therethrough in substantial alignment with a respective receptacle assembly 104. The pluggable module 102 is inserted into the receptacle assembly 104 through the bezel opening 109, and the receptacle assembly 104 is electrically connected to the bezel 108.

In the illustrated embodiment, the pluggable module 102 includes a housing 110 including a base 112 and a cover 114 that are secured together to form a protective shell for a circuit board (not shown in FIG. 1) that is disposed within the housing 110. The circuit board carries electronic circuitry and devices that perform transceiver functions in a known manner. An edge of the circuit board is exposed through a rear 116 of the housing 110, and the circuit board edge is pluggable into the receptacle assembly 104 as described below. Alternatively, a connector may be mounted to the circuit board and exposed through the rear 116 of the housing 110 for plugging into the receptacle assembly 104. The pluggable module 102 is adapted for installation into the receptacle assembly 104 such that a front end 118 of the pluggable nodule 102 is extended therefrom.

The pluggable module 102 is configured to be inserted into the receptacle assembly 104. In general, the pluggable module 102 and receptacle assembly 104 may be used in any application requiring an interface between a host system and electrical or optical signals. The pluggable module 102 interfaces to the host system through the receptacle assembly 104 via a receptacle connector 120 which is located within a receptacle guide frame 122, also referred to as a cage. The pluggable module 102 interfaces to an optical fiber or electrical cable (not shown in FIG. 1) through a connector interface 124 at a front end 118 of the pluggable module 102. Preferably, the connector interface 124 comprises a mechanism that cooperates with a fiber or cable assembly (not shown) to secure the fiber or cable assembly to the pluggable module 102. Suitable connector interfaces 124 are known and include adapters for the LC style fiber connectors and the MTP/MPO style fiber connectors offered by Tyco Electronics Corporation (Harrisburg, Pa.).

The pluggable module 102 and the receptacle assembly 104 reduce EMI emission through one or more of several EMI reduction features, including a guide frame 122, a gasket assembly 125 coupled to a forward end of the guide frame 122 that interfaces with the bezel 108, and intermediate and rear gasket assemblies 123 and 127.

As illustrated in FIG. 1, the guide frame 122 includes a stamped and formed metal body 126 that defines a shell having a top wall 128, a bottom wall 130, and side walls 132, 134. Front edges of each of the top, bottom and side walls 128, 130, 132, 134 are formed as flanges which surround a front opening 136 into the guide frame 122. The top wall 128, the bottom wall 130, and the side walls 132, 134 define a cavity 138 therebetween for receiving the pluggable module 102 through the opening 136 in the front end of the guide frame 122. The bottom wall 130 has a bottom opening to receive the receptacle connector 120. The guide frame 122 has a positive stop 140, which engages a surface of the pluggable module 102 to prevent the pluggable module 102 from passing too far rearwardly through the guide frame 122. When the pluggable module 102 is inserted into the receptacle assembly 104, the guide frame 122 provides conductive walls on all sides thereof. Bottom wall 130 of guide frame 122 includes compliant pin leads 142 that are received within through-holes 144 of the host board 106 and provide a conductive path to ground of an equipment chassis when the receptacle assembly 104 is mounted therein. The host board 106 includes a conductive surface 146 provided thereon and formed as a sheet to underlie the receptacle assembly 104 to enhance the electromagnetic interference shielding.

The receptacle connector 120 is mounted on the circuit board 106 of the host equipment along with the guide frame 122, but separated from the conductive surface 146 of the host board 106. The receptacle connector 120 includes a slot that receives an edge of the circuit board or a connector mounted to the circuit board that is carried by the pluggable module 102 when the pluggable module 102 is fully installed in the guide frame 122, thereby electrically connecting the pluggable module 102 to the host equipment.

The top wall 128 of the guide frame 122 has a large opening 148 overlying the cavity 138 that accommodates an optional heat sink 150. The heat sink 150 is positioned to make physical contact with the pluggable module 102 when the pluggable module 102 is installed into the receptacle assembly 104. A clip 152 is mounted over the heat sink 150 and is secured to the guide frame 122. The clip 152 ensures that the heat sink 150 is loaded against the pluggable module 102 to facilitate thermal transfer from the pluggable module 102 to the heat sink 150. The heat sink 150 includes an engagement surface that faces and is located proximate the interior cavity 138 of the guide frame 122. The engagement surface of the heat sink 150 is configured to physically contact and abut against the pluggable module 102 when installed in the interior cavity 138.

A retention tab 154 is formed on each of the side walls 132, 134 of the guide frame 122. The retention tabs 154 engage the clip 152 which, in turn, retains the heat sink 150 on the guide frame 122. The clip 152 securely engages the guide frame 122 to retain the heat sink 150 upon the guide frame 122. The clip 152 includes resilient spring members 155 secured over the heat sink 150. The spring members 155 flex to permit the heat sink 150 to move outward away from the guide frame 122 when the pluggable module 102 is installed. The spring members 155 exert a desired force against the heat sink 150 to maintain a desired abutting interface to facilitate thermal transfer and heat dissipation from the pluggable module 102. The clip 152 further includes side rails 156 that snap over the side walls 132, 134 of the guide frame 122. The side rails 156 are joined to one another by the spring members 155 that extend over, and flexibly engage, the heat sink 150.

Figure 2:
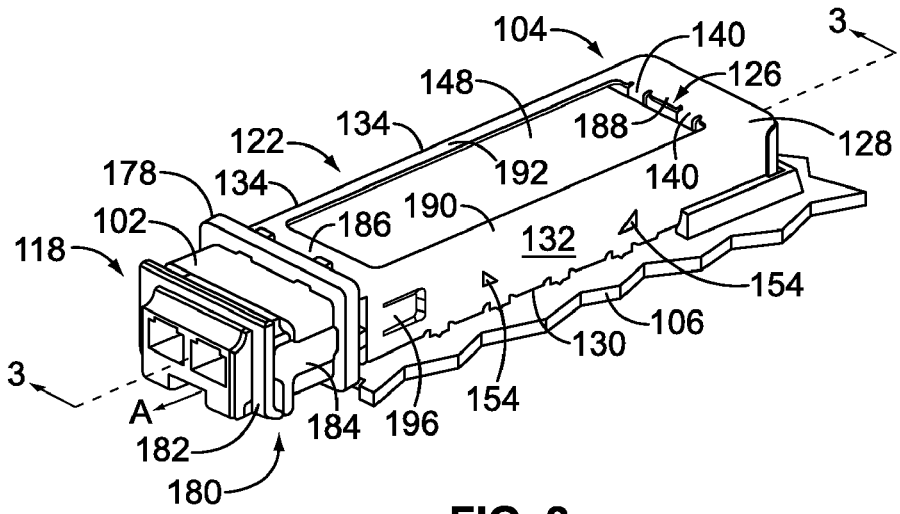
FIG. 2 is an assembled perspective view of a portion of the assembly shown in FIG. 1, showing a pluggable module mated with a receptacle assembly.

FIG. 2 is a perspective view of the receptacle assembly 104 mounted to the host board 106 and receiving the pluggable module 102, with the heat sink 150 and the clip 152 removed for clarity. Also, the bezel 108 is not shown in FIG. 2.

The pluggable module 102 is illustrated in a latched position wherein removal from the guide frame 122 is prevented. An axial pull on the front end 118 of the pluggable module 102 in the direction of arrow A, when latched, is ineffective to remove the pluggable module 102. In the latched position, the front end 118 of the pluggable module 102 extends or protrudes outwardly a specified distance from an EMI gasket collar 178 which is positioned in abutting contact with an interior surface (not shown in FIG. 2) of the bezel 108 (shown in FIG. 1) in use. The pluggable module 102 is extended through collar 178 and guide frame 122. An ejector mechanism 180 is provided on the front end 118 of the pluggable module 102 and includes a rotatably mounted bail 182 and actuator arms 184 extending on opposite sides thereof in a generally parallel direction to the side walls 132, 134 of guide frame 122.

The top wall 128 of the guide frame 122 includes a front portion 186, a rear portion 188, and opposed lateral portions 190, 192 that define a perimeter of the opening 148. The portions 186-192 of the top wall 128 also define a seat for the heat sink 150 (shown in FIG. 1). The top wall 128 supports the heat sink 150 when the heat sink 150 is mounted over the opening 148. Retention tabs 154 are punched from each of the respective side walls 132, 134 and bent outwardly. The retention tabs 154 engage mating openings 198 in the side rails 156 (shown in FIG. 1) in the clip 152 (also shown in FIG. 1) when the heat sink 150 is attached to the guide frame 122. In an exemplary embodiment, the retention tabs 154 are triangular in shape, which restricts the clip 152 from movement in both a vertical and horizontal direction relative to the guide frame 122, although it is recognized that other shapes for tabs 154 maybe employed.

The rear portion 188 of the top wall 128 includes positive stops 140 in the form of downwardly extending tabs that project slightly inward into opening 148 and downward into the cavity 138. The stops 140 engage a rear surface of the pluggable module 102 to prevent the pluggable module 102 from passing rearwardly through the guide frame 122 beyond a specified distance. Each of the side walls 132, 134 of the guide frame 122 includes a latch element 196 that engages a respective cavity in the sidewalls 132, 134 of the pluggable module 102. In the illustrated embodiment, the latch elements 196 are rectangular tabs punched from the respective side walls 132, 134 and bent inwardly into the interior of the cavity 138 of the guide frame 122. When the pluggable module 102 is inserted in the guide frame 122, the latch elements 196 contact the side outer surfaces of the housing 110 (shown in FIG. 1) of the pluggable module 102 and resiliently deflect outwardly to permit insertion of the pluggable module 102. Once the pluggable module 102 is inserted a predetermined distance into the guide frame 122, the latch elements 196 return to the latched position illustrated in FIG. 2 in engagement with the cavity in the sidewalls 132, 134.

Figure 3:
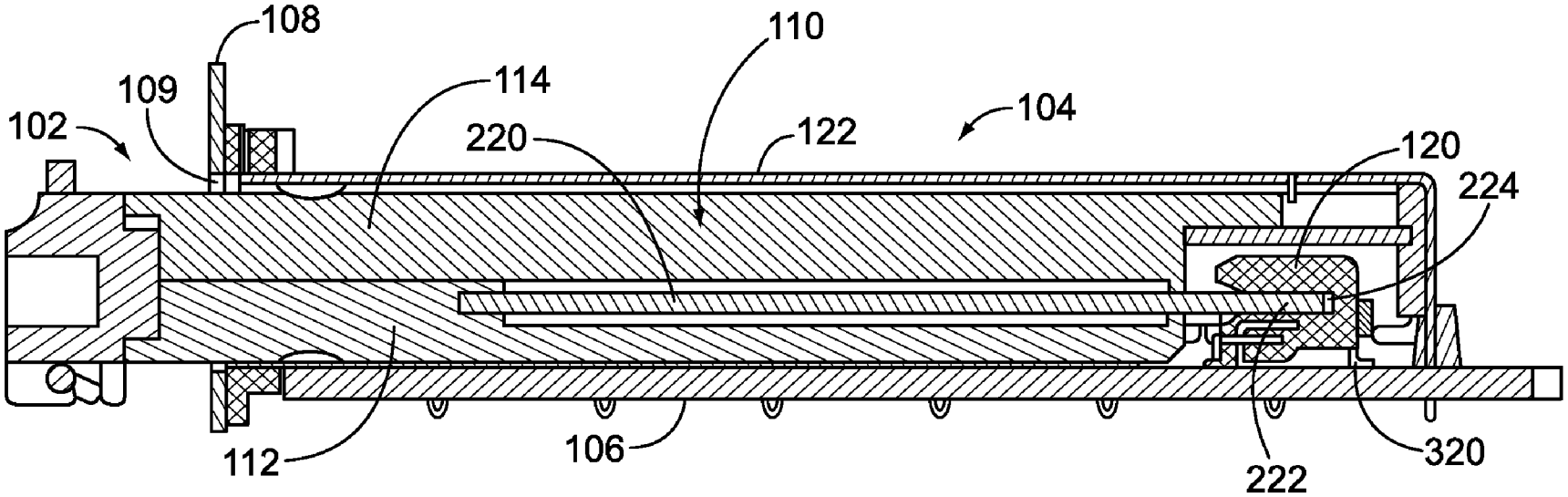
FIG. 3 is a cross sectional view of a portion of the assembly shown in FIG. 1, showing the pluggable module mated with the receptacle assembly.

FIG. 3 is a cross sectional view of the pluggable module 102 coupled to the receptacle assembly 104 with the pluggable module 102 in the latched position. The pluggable module 102 includes a printed circuit board 220 therein. An end 222 of the printed circuit board 220 is received in a slot 224 of the receptacle connector 120 which is mechanically and electrically mounted to the host board 106. The receptacle connector 120 includes electrical contacts 320 that contact conductive terminations on the end of the printed circuit board 220 to establish electrical connection to conductive paths on the host board 106. When the pluggable module 102 is inserted in to the guide frame 122, the end 222 of the printed circuit board 220 is inserted into the connector slot 224, and when the pluggable module 102 is fully inserted into the guide frame 122, the pluggable module 102 is locked in the latched position with the printed circuit board 220 fully engaged to the receptacle connector 120.

Figure 4:
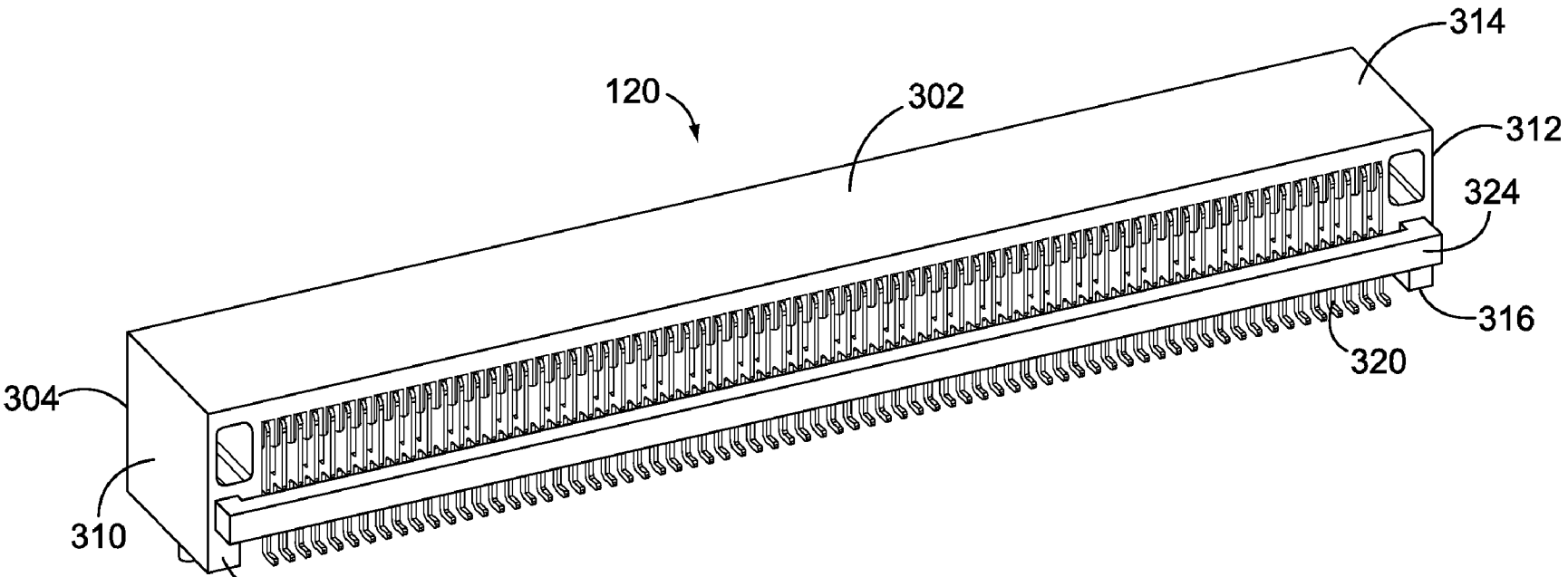
FIG. 4 is a rear perspective view of a receptacle connector for a receptacle assembly and formed in accordance with an exemplary embodiment.

FIG. 4 is a rear perspective view of the receptacle connector 120 for the receptacle assembly 104 (shown in FIG. 1). The receptacle connector 120 includes a housing 302 having a front 304 and a rear 306. The receptacle connector 120 is configured to mate with a mating connector, such as the pluggable module 102, at the front 304. For example, the printed circuit board 220 may be received in the slot 224 (shown in FIG. 3) open at the front 304. The housing 302 includes opposed sides 310, 312 and a top 314 generally opposite a bottom 316. The bottom 316 is configured to be mounted to a circuit board, such as the host board 106.

The receptacle connector 120 includes a plurality of contacts 320 loaded into the cavity 322 (shown in FIG. 7) of the housing 302. The contacts 320 are loaded through the rear 306 of the housing 302. The receptacle connector 120 also includes a retention plug 324 separately provided from the housing 302 and securely coupled to the housing 302, such as at the rear 306. The retention plug 324 engages the contacts 320 to hold the contacts 320 within the cavity 322. For example, the retention plug 324 resists rearward movement of the contacts 320 out of the cavity 322.

Figure 5:
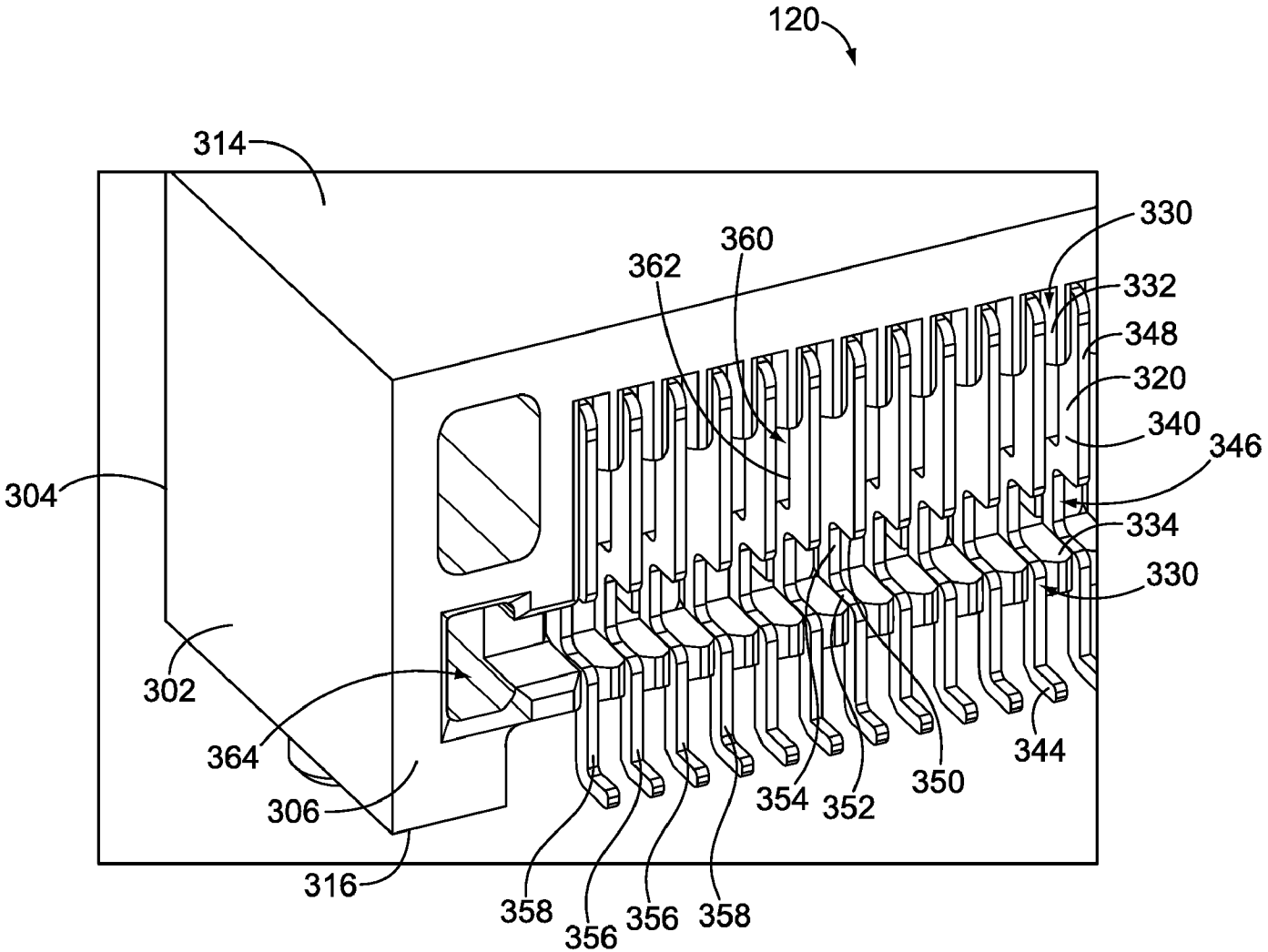
FIG. 5 is a rear perspective view of a portion of the receptacle connector shown in FIG. 4.

FIG. 5 is a rear perspective view of a portion of the receptacle connector 120 with the retention plug 324 (shown in FIG. 4) removed for clarity. In an exemplary embodiment, the housing 302 includes a plurality of grooves 330 formed therein at the rear 306 of the housing 302. The grooves 330 receive corresponding contacts 320 therein. The grooves 330 help hold the contacts 320 in position relative to one another (e.g. side-to-side position).

The grooves 330 are generally formed by wall portions 332, 334 positioned between the contacts 320. The wall portions 332, 334 of the housing 302 are formed from a dielectric material. Electrical characteristics of the contacts 320 are controlled by selecting a particular type of dielectric material for the wall portions 332, 334 and/or by controlling the height of the wall portions 332, 334 between the contacts 320. Between the wall portions 332, 334, the contacts 320 are separated from one another by air, which has a different dielectric constant than the wall portions 332, 334, and thus affects the electrical characteristics of the contacts 320 differently then the wall portions 332, 334.

Each contact 320 includes a post 340 and a tail 342 (shown in FIG. 7) that extends generally perpendicular from the post 340. For example, the posts 340 are oriented generally parallel to the rear 306 of the housing 302 and are positioned proximate to the rear 306. The tails 342 are oriented generally parallel to the top 314 of the housing 302 and are positioned proximate to the top 314. Optionally, the posts 340 are exposed to the exterior of the housing 302 at the rear 306, while the tails 342 are not exposed, but rather are covered by the top 314. In an exemplary embodiment, each contact 320 includes a mounting end 344 configured to be mounted to the host board 106 (shown in FIG. 1). Optionally, the mounting end 344 may extend generally perpendicular with respect to the post 340 and be oriented for surface mounting to the host board 106, such as by soldering. Alternatively, the mounting end 344 may be a pin, such as a compliant pin, for through hole mounting to the host board 106.

In an exemplary embodiment, the post 340 includes a rear facing channel portion 346 with an open side aligned with an outer surface 348 of the post 340. The channel portions 346 are aligned with one another. The channel portion 346 is configured to receive the retention plug 324 (shown in FIG. 4), as will be described in further detail below. In an exemplary embodiment, the channel portion 346 is defined by an upper edge 350, a lower edge 352 and a bottom edge 354 generally opposite the open side. Any or all of the edges 350-354 may engage the retention plug 324. Additionally, the outer surface 348 of the post 340 may engage the retention plug 324.

In the illustrated embodiment, the contacts 320 include both signal contacts 356 and ground contacts 358. Other types of contacts, such as power contacts, may be used in alternative embodiments or alternative applications. Optionally, the signal contacts 356 may be arranged in pairs with each signal contact 356 within a pair carrying a differential signal, thus defining a differential pair. One ground contact 358 is provided between each pair of signal contacts 356. Each pair of signal contacts 356 are flanked by ground contacts 358. A ground-signal-signal-ground contact arrangement is thus provided. Other contact arrangements may be provided in alternative embodiments.

In an exemplary embodiment, the ground contacts 358 have a dimension from front to rear between the channel portions 346 and the tails 342 that is greater than the dimension from front to rear of the equivalent section (e.g. the aligned section) of the signal contacts 356. The ground contacts 358 reduce crosstalk between differential pairs by being wider than the signal contacts 356. In an exemplary embodiment, the signal contacts 356 include a forward facing channel portion 360 between the rear facing channel portions 346 and the tails 342. The forward facing channel portions 360 include an inner surface 362 that is spaced apart from the housing 302 to provide an air gap between the signal contacts 356 in the housing 302. Optionally, the ground contacts 358 abut the housing 302 such that no air gap is formed between the ground contact 358 and housing 302.

The housing 302 is open between the channel portions 346 of the contacts 320. In an exemplary embodiment, the housing 302 includes an aperture 364 for receiving a portion of the retention plug 324. Optionally, the retention plug 324 may be securely coupled to the housing 302 by frictionally engaging the walls defining the aperture 364.

Figure 6:
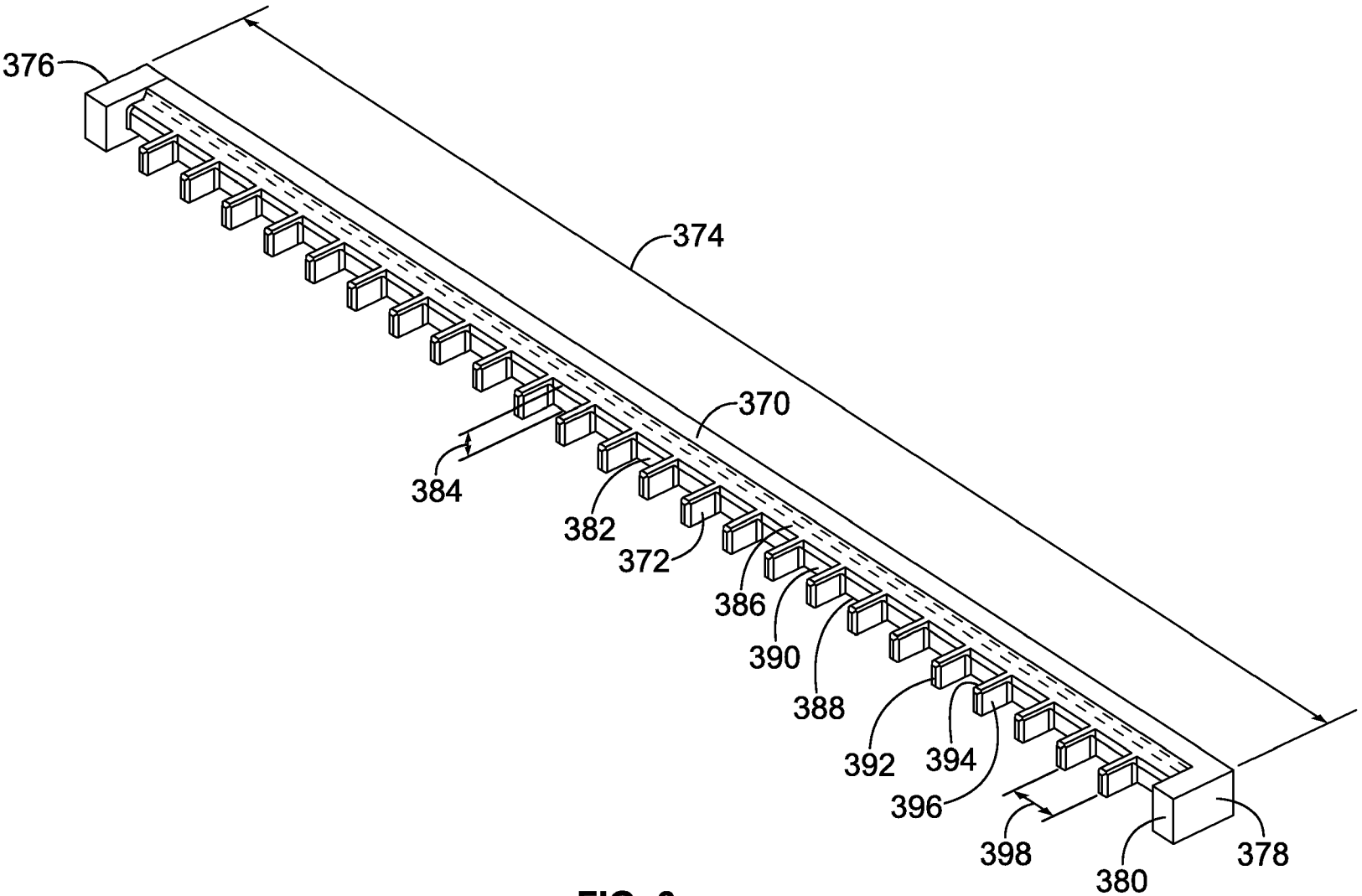
FIG. 6 illustrates a retention plug for the receptacle connector shown in FIG. 4.

FIG. 6 illustrates the retention plug 324 for the receptacle connector 120 (shown in FIG. 4). The retention plug 324 includes an elongated base 370 and plurality of fingers 372 that extend forward from the base 370. The base 370 has a width 374 measured between opposed sides 376, 378 that spans the rear 306 (shown in FIG. 4) of the housing 302 (shown in FIG. 4). A pair of arms 380 are provided at corresponding sides 376, 378. The arms 380 may be received in the apertures 364 (shown in FIG. 5) to securely couple the retention plug 324 to the housing 302. Other types of retention features may be used in alternative embodiments to securely couple the retention plug 324 to the housing 302.

In an exemplary embodiment, the base 370 includes a stuffer portion 382 having a reduced height 384 as compared to a height of the base 370. The fingers 372 extend forward from the stuffer portion 382. The stuffer portion 382 is sized to fit within the channel portions 346 (shown in FIG. 5) of the contacts 320 (shown in FIG. 5). Optionally, the stuffer portion 382 may fit snugly within the channel portions 346 such that the stuffer portion 382 engages the edges 350-354 (shown in FIG. 5) defining the channel portions 346. For example, the stuffer portion 382 may include an upper surface 386, an opposite lower surface 388, and forward facing surface 390 extending therebetween. The surfaces 286-390 engage the edges 350-354, respectively.

The fingers 372 extend from the base 370 to a tip 392. The tip 392 may be rounded. The fingers 372 have opposed side surfaces 394, 396. The side surfaces 394, 396 may be smooth. The fingers 372 are spaced apart by the spacing 398. Optionally, the spacing 398 may be the same, or substantially the same, between each adjacent fingers 372. Alternatively, the spacing between different ones of the fingers 372 may be different.

Figure 7:
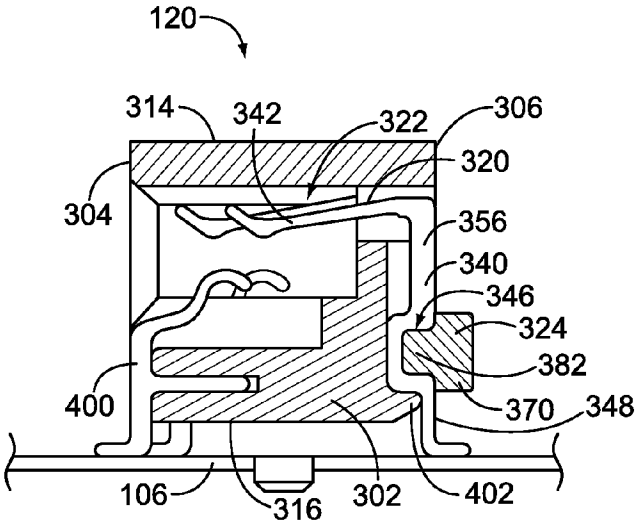
FIG. 7 is a cross sectional view of a portion of the receptacle connector shown in FIG. 4.

FIG. 7 is a cross sectional view of a portion of the receptacle connector 120 taken along one of the signal contacts 356. The receptacle connector 120 is illustrated mounted to the host board 106. The contacts 320 are received in the housing 302 and are configured for mating with the mating connector, such as the pluggable module 102 (shown in FIG. 1). The tails 342 extend from the posts 340 into the cavity 322 and are arranged for mating with mating contacts of the mating connector. In particular, the tails 342 are arranged for mating with an upper row of mating contacts of the mating connector. The contacts 320 may thus be referred to as upper contacts 320 because the tails 342 extend along an upper portion of the mating connector.

The mating connector may also include a lower row of contacts, in which case, lower contacts 400 may additionally be received within the housing 302 and electrically connected to the host board 106. The lower contacts 400 are loaded into the housing 320 through the front 304 of the housing 302. In an alternative embodiment, the lower contacts 400 may be loaded into the housing 320 through the rear 306 in a similar manner as the upper contacts 320.

The signal contact 356 is held in the housing 302 by the retention plug 324. For example, during assembly, the signal contact 356 is loaded through the rear 306 of the housing 302 into the corresponding groove 330 (shown in FIG. 5). The channel portion 346 may rest upon a ledge 402 of the housing 302. The ledge 402 vertically positions the signal contact 356 with respect to the top 314 and the bottom 316. The ledge 402 aligns each of the channel portions 346 with one another for mating with the retention plug 324. Once the signal contact 356 is positioned, the retention plug 324 is coupled to the housing 302. The retention plug 324 engages the signal contact 356 to hold the signal contact 356 within the housing 302. For example, the retention plug 324 resists rearward movement of the signal contact 356. When assembled, the stuffer portion 382 of the base 370 is received within the channel portion 346. The remainder of the base 370 may be positioned behind the outer surface 348 of the post 340.

Figure 8:
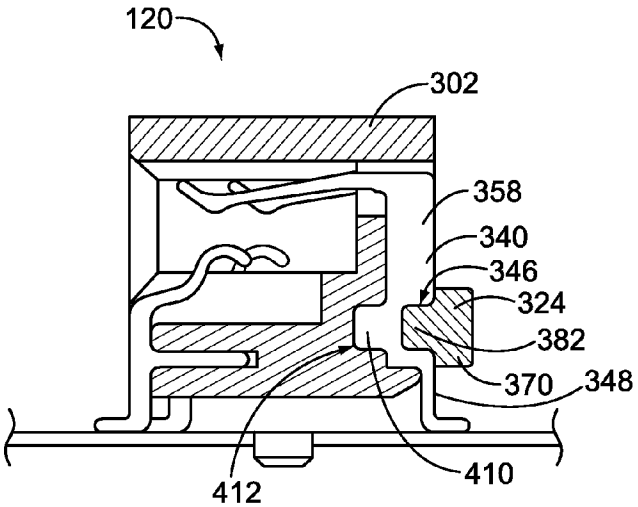
FIG. 8 is another cross sectional view of a another portion of the receptacle connector shown in FIG. 4.

FIG. 8 is a cross sectional view of a portion of the receptacle connector 120 taken along one of the ground contacts 358. The ground contact 358 is loaded into the housing 302 in a similar manner as the signal contact 356. Optionally, the ground contact 358 is loaded into the housing 302 such that the post 340 abuts against a rear facing surface of the housing 302. The ground contact 358 is held in the housing 302 by the retention plug 324 in a similar manner as the signal contact 356. For example, the stuffer portion 382 of the base 370 is received within the channel portion 346. The remainder of the base 370 may be positioned behind the outer surface 348 of the post 340.

In an exemplary embodiment, the ground contact 358 includes a retention barb 410 extending forward from the post 340. Optionally, the retention barb 410 may be aligned with the channel portion 346. The retention barb 410 is received in an aperture 412 formed in the housing 302. The retention barb 410 frictionally engages the walls defining the aperture 412 to hold the ground contact 358 within the housing 302.

Figure 9:
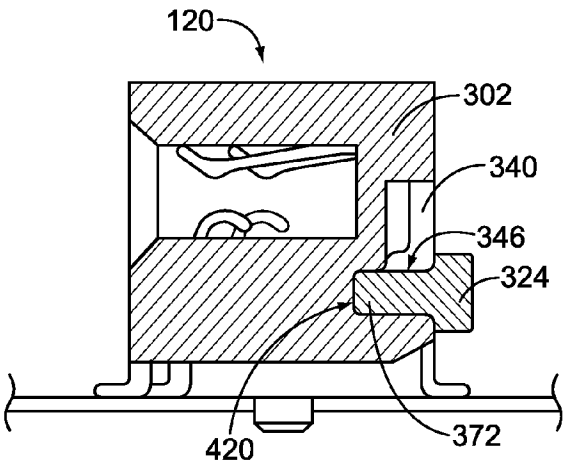
FIG. 9 is a further cross sectional view of a different portion of the receptacle connector shown in FIG. 4.

FIG. 9 is a cross sectional view of a portion of the receptacle connector 120 taken along one of the fingers 372 of the retention plug 324. The retention plug 324 is coupled to the housing 302 such that the finger 372 extends into an aperture 420 formed in the housing 302. Optionally, the finger 372 frictionally engages the walls defining the aperture 420 to hold the retention plug 324 within the housing 302.

When assembled, the finger 372 covers a portion, such as the channel portion 346, of the post 340 such that the finger 372 is positioned between the post 340 and an adjacent post 340 of an adjacent contact 320. As such, portions of adjacent contacts 320 are separated from one another by the dielectric material of the finger 372. As illustrated in FIG. 9, a portion of the post 340 is not covered by the retention plug 324 or the walls of housing 302, but rather remains exposed to air.

Figure 10:
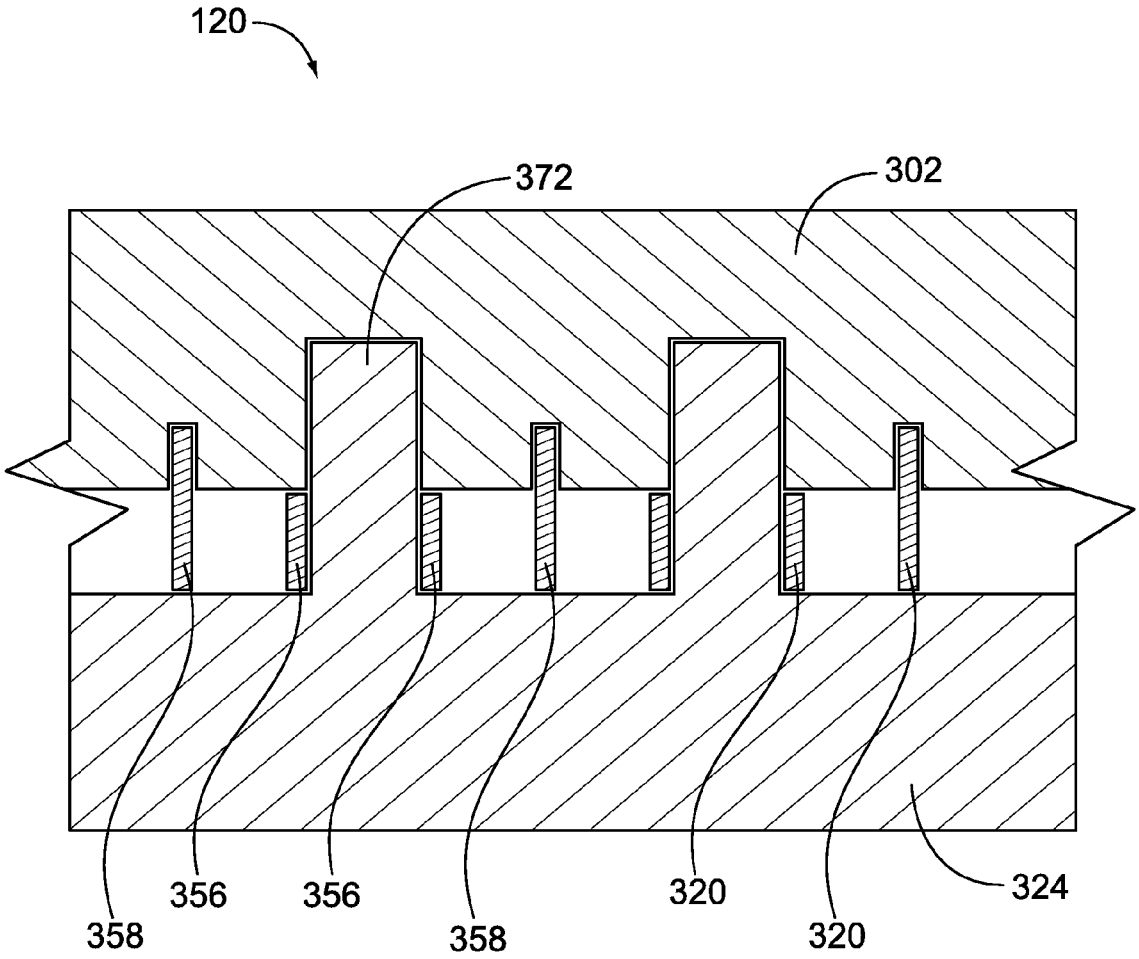
FIG. 10 is a cross sectional view of yet another portion of the receptacle connector shown in FIG. 4.

FIG. 10 is a cross sectional view of yet another portion of the receptacle connector 120 taken through the contact portions 346 (shown in FIG. 5) of the contacts 320. FIG. 10 illustrates the receptacle connector 120 in an assembled state with the retention plug 324 coupled to the housing 302. The contacts 320 are arranged in a ground-signal-signal-ground contact arrangement. The signal contacts 356 as well as the ground contacts 358 are positioned adjacent to the housing 302 at the contact portion 346. The ground contacts 358 include the retention barbs 410 that extend into the housing 302. The fingers 372 of the retention plug 324 also extend into the housing 302. The fingers 372 are located between the adjacent signal contacts 356 of the differential pair. As such the dielectric material forming the retention plug 324 substantially fills the space between the signal contacts 356. In contrast, air or another dielectric material having a dielectric constant that is different than the material forming the finger 372, substantially fills the space between the signal contact 356 and the corresponding adjacent ground contact 358. Thus, the electrical characteristics of the contacts 320 may be affected by the retention plug 324, and in particular the position of the finger 372 with respect to the contacts 320. For example, by positioning the finger 372 between the signal contacts 356, coupling may be enhanced between the signal contacts 356. By providing air between the signal contacts 356 and the ground contacts 358, coupling between the signal contacts 356 and the ground contacts 358 may be diminished as compared to the coupling between the adjacent signal contacts 356.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle connector comprising:

a housing having a front and a rear, the housing includes a cavity configured to receive a mating connector through a slot at the front of the housing;

a plurality of contacts loaded into the cavity of the housing through the rear of the housing, the contacts having channel portions aligned with one another; and a retention plug separately provided from the housing and securely coupled to the rear of the housing, the retention plug being received within the channel portions of the contacts and engaging the contacts to hold the contacts within the cavity.

2. The receptacle connector of claim 1, wherein the retention plug includes fingers extending between adjacent contacts into apertures in the rear of the housing, the fingers secure the retention plug to the housing.

3. The receptacle connector of claim 1, wherein the contacts constitute signal contacts and ground contacts arranged in a ground-signal-signal-ground pattern, the retention plug includes fingers extending between adjacent signal contacts.

4. The receptacle connector of claim 1, wherein the contacts include a post and a tail extending generally perpendicular from the post, the tails extend into the cavity, the channel portions being formed in the post.

5. The receptacle connector of claim 1, wherein the contacts include a post and a tail extending generally perpendicular from the post, the posts have a rear facing outer surface, the channel portions being recessed from the outer surface.

6. The receptacle connector of claim 1, wherein the retention plug has an elongated base and a stuffer portion extending from the base, the stuffer portion being thinner than the base, the stuffer portion filling the channel portions.

7. The receptacle connector of claim 1, wherein the contacts include a post and a tail extending generally perpendicular from the post, the post extends between the tail and a mounting end configured for mounting to a circuit board, the post includes the channel portions.

8. The receptacle connector of claim 7, wherein the contacts constitute signal contacts and ground contacts, the posts of the ground contacts being wider than the posts of the signal contacts for a majority of the length of the contacts.

9. The receptacle connector of claim 7, wherein the contacts constitute signal contacts and ground contacts, the ground contacts include barbs engaging the housing by a friction fit to hold the ground contacts to the housing, the barbs being aligned with the retention plug.

10. The receptacle connector of claim 1, wherein the retention plug resists rearward movement of the contacts.

11. A receptacle connector for mating with a pluggable module of a transceiver assembly, the receptacle connector comprising:

a housing having a front and a rear, the housing includes a cavity configured to receive a mating connector through a slot at the front of the housing;

a plurality of contacts loaded into the cavity of the housing through the rear of the housing, the contacts defining signal contacts and ground contacts arranged in a ground-signal-signal-ground arrangement; and a retention plug separately provided from the housing and securely coupled to the rear of the housing, the retention plug having a base and a plurality of fingers extending from the base, the retention plug being coupled to the housing and engaging the contacts to hold the contacts within the cavity, the retention plug being arranged such that the fingers are positioned between adjacent signal contacts.

12. The receptacle connector of claim 11, wherein the contacts have channel portions aligned with one another, the channel portions receive a portion of the retention plug, the channel portions of adjacent signal and ground contacts are separated from one another by air.

13. The receptacle connector of claim 11, wherein the contacts include a post and a tail extending generally perpendicular from post, the posts of the ground contacts include a rear facing channel portion, the posts of the signal contacts include a rear facing channel portion and a forward facing channel portion between the rear facing channel portions and the tails.

14. The receptacle connector of claim 13, wherein the rear facing channel portions of the signal contacts and the ground contacts are aligned with one another and receive the retention plug.

15. The receptacle connector of claim 11, wherein the contacts are contained within the perimeter of the housing.

16. The receptacle connector of claim 11, wherein the retention plug has an elongated stuffer portion extending from the base, the stuffer portion being thinner than the base, the stuffer portion filling channel portions formed in the contacts.

17. The receptacle connector of claim 11, wherein the fingers extend between adjacent signal contacts into apertures in the rear of the housing, the fingers secure the retention plug to the housing.

18. A transceiver assembly comprising:

a receptacle guide frame configured to be mounted to a host circuit board, the receptacle guide frame having a front being open to an interior space, the receptacle guide frame being configured to receive a pluggable module through the front; and a receptacle connector received within the interior space of the receptacle guide frame at a rear of the receptacle guide frame, the receptacle connector comprising:

a housing having a front and a rear, the housing includes a cavity configured to receive the pluggable module through a slot at the front of the housing;

a plurality of contacts loaded into the cavity of the housing through the rear of the housing; and a retention plug separately provided from the housing and securely coupled to the rear of the housing, the retention plug having an elongated base extending along the rear of the housing, the base engaging the contacts to hold the contacts within the cavity.

19. The assembly of claim 18, wherein the contacts define signal contacts and ground contacts arranged in a ground-signal-signal-ground arrangement, and wherein the retention plug includes a plurality of fingers extending from the base, the fingers being positioned between adjacent signal contacts.

20. The assembly of claim 18, wherein the contacts define signal contacts and ground contacts arranged in a ground-signal-signal-ground arrangement, and wherein the contacts have channel portions aligned with one another, the channel portions receive a portion of the retention plug, the channel portions of adjacent signal and ground contacts are separated from one another by air.

* * * * *